United States Patent [19]

Kortmann et al.

[11] Patent Number: 4,695,315

[45] Date of Patent: Sep. 22, 1987

[54] METHOD OF MINIMIZING REDUCTION DISINTEGRATION OF IRON ORES AND IRON ORE AGGLOMERATES TO BE USED AS BLAST FURNACE BURDEN

[75] Inventors: Heinrich Kortmann, Liebenburg; Wolfgang Bock, Langelsheim, both of Fed. Rep. of Germany

[73] Assignee: Studiengesellschaft für Eisenerzaufbereitung, Liebenberg, Fed. Rep. of Germany

[21] Appl. No.: 630,593

[22] Filed: Jul. 13, 1984

Related U.S. Application Data

[63] Continuation-in-part of Ser. No. 000,209, Oct. 13, 1983.

[30] Foreign Application Priority Data

Nov. 13, 1982 [DE] Fed. Rep. of Germany ..... 3242086

[51] Int. Cl.[4] ..... C21B 5/00; C22B 1/14

[52] U.S. Cl. ..... 75/0.5 R; 75/3; 75/41

[58] Field of Search ..... 75/41, 42, 257, 0.5 R, 75/3, 5, 29, 30, 26

[56] References Cited

U.S. PATENT DOCUMENTS 2,771,355 11/1956 Cohen ..... 75/41
2,888,341 5/1959 Lawless et al. ..... 75/3
3,062,639 11/1962 Sterling ..... 75/26
3,615,342 10/1971 Bare ..... 75/5
3,975,182 8/1976 Goetzman ..... 75/257

FOREIGN PATENT DOCUMENTS 289727 1/1916 Fed. Rep. of Germany .

*Primary Examiner*—Melvyn J. Andrews
*Attorney, Agent, or Firm*—Horst M. Kapser

[57] ABSTRACT

A method and a product is provided for reducing the reduction disintegration of iron ores and iron ore agglomerates. The raw iron ores or iron ore agglomerates are treated with materials containing halogen and preferably with halogenide solutions. The degree of the improvement of reducing disintegration in a reduction furnace such as a blast or low shaft furnace at temperatures from about 400 to 600 degrees centigrade depends on the concentration employed. The type of reagent has its particular effect, because the reagents contain stochiometrically different high proportions of halogens. It is found that reduction disintegration declines with the increased halogenide concentration in the pieces of ores or agglomerates employed. In order to minimize the amount of extraneous materials introduced, the lowest possible concentration is advantageously determined for each burden component.

23 Claims, No Drawings

METHOD OF MINIMIZING REDUCTION DISINTEGRATION OF IRON ORES AND IRON ORE AGGLOMERATES TO BE USED AS BLAST FURNACE BURDEN

CROSS-REFERENCE TO RELATED APPLICATIONS

This application is a continuation-in-part application of another application filed Oct. 13, 1983 and bearing application Ser. No. PCT/DE83/00209. This claim is made under Section 35 U.S.C. 365 (c), under Section 35 U.S.C. 371 and under any other Section of the U.S.C. supporting such claim.

BACKGROUND OF THE INVENTION

1. Field of the Invention

The present invention relates to a process for minimizing disintegration in the blast furnace and low shaft furnace of iron ores and iron ore agglomerates.

2. Brief Description of the Background of the Invention Including Prior Art

The disintegration of iron ores and iron ore agglomerates at the beginning of reduction (reduction disintegration) in the low temperature range from about 400 degrees centigrade to 600 degress centigrade in a weakly reducing atmosphere is regarded by competent professionals as an extremely negative characteristic of a blast furnace burden material. As is well known, high reduction disintegration results in high flue dust production and scaffolding, hinders gas distribution, raises the consumption of fuel and reducing gas, lowers the production capacity and deteriorates the pig iron quality. The technical drawbacks listed above mean, at the same time, quite remarkable economic disadvantages. For instance, high reduction disintegration can bring about a rise in fuel consumption—either in the form of coke or oil—by up to 10 percent of normal consumption, which presently amounts to between 400 and 500 kg per ton of pig iron.

An early teaching exists with the purpose to prevent the decomposition of iron ores and iron ore briquettes, which is contained in the German Patent DE-P289,727 of Jan. 14, 1916 to Det Norske. According to the teaching of this reference a glaze-like coating is formed with sodium chloride around the ore particles. According to the teaching of the reference the treatment materials are to be added to the ore or ore products during the smelting process in a furnace. It is also mentioned that a certain amount of the treatment salt is added to the ore or iron ore briquettes immediately ahead of its use in the blast furnace with the goal of a glaze formation. Thus the reference teaches the formation of a glaze in order to enhance the strength via the glazing. The reference teaches further that based on this step the catalyst effectiveness of the ore is to be reduced, which enhances the deposition of carbon in the ore or in the briquettes, a clearly undesirable feature.

Other attempts of strengthening ores or sintered products have been made such as are taught for example in D. F. Ball et al. "Agglomeration of Iron Ores", American Elsevier Publishing Co., New York, N.Y. (page 304, lines 27 to 32); A Be in 677,083 of Aug. 25, 1966 (C.N.R.M.); and K Meyer, "Pelletizing of Iron Ores", Springer Verlag, Berlin, 1980, pages 37, 56, 109, 116, 126, 161, and 184 to 188. According to these references the addition of reagents is provided before their production, that is the additives are added already to the starting materials for making the agglomerates. This method entails the disadvantage that the additives can be directed to the production process of the agglomerates, but they will in general not be specific for the specific purpose of controlling the behavior of the agglomerated material in the blast furnace.

In order to keep disintegration of the blast furnace burden as low as possible, cerain requirements must be met by the major burden materials—sinter and pellets—which are permanently controlled and which must be corrected if the limiting values fall below specifications.

Such corrections are made, for instance, by changing basicities, the type of base-bearing components, the degrees of oxidation or by operational steps which always mean higher fuel consumption which can exceed the normal amount by 5 to 10%.

Nevertheless, in spite of all these measures, today's requirements relating to reduction disintegration, cannot be met. Besides, there are certain pellet grades whose tendency to disintegration at the beginning of reduction in the blast furnace is quite pronounced after a storage period from 2 to 3 weeks only.

Even though the disintegration which is caused by the storage, can be met either by shorter storage periods or by adding certain amounts of basic additives, it must be pointed out that this can be realized to a limited extent only, with higher production cost of the pellets and, in part, metallurgical disadvantages. Often there is the only choice: to directly adapt the production to the actual needs. As a consequence, operating plants must frequently close down.

Here, the invention proves a remedy. It is the objective of this invention to propose a method, by which the disintegration of iron ores and iron ore agglomerates, which are charged as burden into the blast furnace, and which disintegration starts at the beginning of reduction in the low-temperature range, is minimized. The invention solves the problem in such a manner that iron ore agglomerates, after their induration and prior to smelting, and iron ores prior to smelting in the blast furnace, are treated with reagents which prevent them, to a large extent, from disintegrating during reduction in the temperature range from 400° C. to 600° C.

According to the invention, reduction disintegration of a burden component can decisively be minimized, if the burden component, prior to its charge into the blast furnace, is treated with halogen solutions. These solutions or suspensions of halogens and their compounds, respectively, may consist of NaCl, $CaCl_2$, KCl, KJ, KBr, $Na_2SiF_6$. In their simplest form the halogens may, for instance, be brought in from sea water (NaCl).

The advantages of the invention are, that the treatment is done in a very simple manner by powdering or spraying on or by immersion of the burden material into the corresponding solutions which are effective even in high dilution. The result of the treatment is a considerable minimizing in disintegration, depending on the type of burden, the reagent and its concentration. Other quality characteristics, as, for instance, mechanical strength, reducibility, strength at 1,050° C. reduction temperature are not at all changed by the treatment.

The invention method for minimizing disintegration of pieces of iron ores and iron ore agglomerates, preferably sinter material and pellet form in a reduction furnace comprises treating iron ores and iron ore agglomerates otherwise ready to be fed to the reduction furnace with reagents, which minimize disintegration of the ores and agglomerates when exposed to temperatures in the range of from about 400 to 600 degrees centigrade.

The reagents employed can be solutions containing halogenides, a member of the group comprising sea water, liquids similar to sea water, and aqueous solutions containing halogen in an amount of from about 0.1 to 50 grams per liter, and preferably aqueous solutions containing halogenides, where the amount of halogen is from about 1 to 20 gram per liter of solution, which appears for technical reasons presently to be the most preferred method based on technical practicability. Materials useful in providing the halogenide to the pieces include the halogenides of the metals having a number of less then about 55 and preferably of less than 30 in the periodic table of Mendelejev. Preferred halogenides are those which evaporate at temperatures of from about 600 to 800 degrees centigrade under blast furnace conditions. The specific reagent employed can be an aqueous solution containing a member of the group consisting of sodium chloride, magnesium chloride, calcium chloride, potassium chloride, potassium iodide, potassium bromide, sodium hexafluoro silicate, and mixtures thereof. The treating can be performed until the pieces have an analytical content of from about 0.001 to 0.1 weight percent in halogen and preferably of from about 0.01 to 0.03 weight percent in halogen.

It has further been found that higher rates of addition as compared to the rates recited according to the present invention do not enhance the effects of the present invention. In contrast, higher rates delay the reduction too much and they load the blast furnace with damaging elements extensively and unnecessarily. In addition, it was found in tests at 500 degrees centigrade that there was somehow an increased decomposition if larger amounts of halogenides are present.

It has been found that a critical point as to the strength of cohesion of pellets, sinter, sintered briquettes and ores under reducing conditions is the reduction in the temperature region of from about 400 to 600 degrees centigrade in a weakly reducing atmosphere, as it occurs in the upper parts of a blast furnace. A loss in strength is expressed as a so-called falling apart of the grains and pieces. An increased and too high falling apart of the the grains results in an interference with the gas flow passage, in an increased flue dust from the throat of the furnace, and finally in a lower smelting efficiency. It has been found that a suitable test method for testing the grain and piece disintegration under reducing conditions is a externally heated electrical rotary tube furnace or a rotary kiln. After the testing in such a furnace the sample is subjected to a sieve analysis, since the grain structure of the reduced sample is a measure for the grain and piece disintegration. The percentage weight part of the tested sample not passing a sieve of 6.3 millimeter or, respectively 3.15 millimeter diameter of the apertures (+6.3 mm or +3.15) is designated as disintegration strength and the weight percentage of material passing through a sieve with 0.5 millimeter apertures (−0.5 millimeter) is designated as disintegration abrasion dust. For example, in the Federal Republic of Germany at present the following limiting values are to be achieved for the use of pellets and ores in modern blast furnaces:

At least 80 weight percent of grains and pieces with a size of more than 6.3 millimeter.

At most 15 weight percent of grains and pieces with a size of less than 0.5 millimeter.

In theory, according to the present invention all compounds can be considered for the treatment which contain halogenides. The effect of such a treatment however is the larger, the larger the contents of halogenides is in a compound employed, since only the halogenides are responsible for an effect. The reason for this is that the halogen compounds introduced by dipping, spraying or mingling with powder followed by treatment with water results in a deposition of the halogen compounds at the grains or pieces and preferably at cracks or pores. This reduces or prevents the flow and passage of the reducing gases as long as halogenides are still present. The halogenides evaporate if their partial vapor pressure becomes sufficiently high. This depends on the temperature level and the kind of the halogenide carrier, since the evaporation temperature is in the area of from about 600 to 800 degrees depending on the kind of halogenide carrier. Only above the temperature range of about 600 to 800 degrees centigrade the surfaces, cracks and pores become free again and only thereafter the reducing gases become substantially active. This process can be controlled with the kind of addition and the rate of addition of the additives. The premature reduction as a substantial cause for the disintegration can thereby be controlled and/or prevented. The reduction decomposition can be reduced up to about zero depending on the rate and kind of the additive. Already in case of addition rates from about 0.001, which is equal to 10 grams per ton of pieces of agglomerate or ore, the effect is observed. In most cases rates of about 0.02, which is equal to about 200 grams per ton, have shown to be sufficient in all cases as nearly completely preventing reduction disintegration. The halogenides can be added at the producer of the pieces or at the user location. In addition, agglomerates aged by storage can again be made free of disintegration.

The reagents can be sprayed upon the pieces. This can be effected in apparatus like that employed in a coke plant for cooling the coke. Alternatively, the reagents contain halogen and are in solid form at the time of treatment. The pieces can also be immersed in a bath containing a solution of halogenides. This can for example be effected with a dipping bath. The pieces can be disposed on a transporting belt during the treatment process. The times of treatment are not critical, but a relatively homegeneous distribution of the reagent over the pieces is preferred.

Furthermore, the present invention provides pieces of iron ore and iron ore agglomerates containing a deposit of a soluble halogenide on its surfaces accessible to contact with liquid, where the total amount of halogenide corresponds to an analytical content of from about 0.01 to 0.05 weight percent of halogen of the piece. The halogenide can comprise a member of the group consisting of sodium chloride, magnesium chloride, calcium chloride, ferrous chloride, ferric chloride, potassium chloride, manganese chloride, and mixtures thereof and the analytical halogen concentration in the pieces can be from about 0.001 to 0.1 and is preferably from about 0.01 to 0.03 weight percent.

Thus the invention method minimizes disintegration in the blast and low-shaft furnace, respectively, of iron ores and iron ore agglomerates at the beginning of reduction in the temperature range between 400 and 600 degrees centigrade, where the iron ores before charging into smelting aggregates, and the iron ore agglomerates after their production and before smelting are treated with reagents, which, to a great extent, inhibit or, respectively, minimize disintegration.

The reagents can be in the form of solutions or sea water or liquids similar to sea water, which contain halogens in the order of 0.1 gram per liter to 50 gram per liter. The solutions containing halogens can be sprayed upon the iron ores and iron ore agglomerates, respectively. The reagents intended for treatment and containing halogens, can be of a solid form. The iron ores and iron ore agglomerates, respectively, for halogen absorption are immersed in a bath which consists of a solution containing halogens. The reagents existing in solid form, can be applied to iron ores and iron ore agglomerates, respectively. The iron ores and iron ore agglomerates, respectively, which were treated with the halogen compounds, may be protected against washing out by water. The treatment of the iron ores and, respectively, the iron ore agglomerates either with solutions containing halogens, or, otherwise, in solid form, with reagents containing halogens, is effected immediately prior to charging into smelting aggregates.

However, special attention should be paid to the fact, that it is possible to produce deliberately, through a reduced fuel rate, agglomerates which still meet the requirements of mechanical strength, but whose disintegration values are not satisfactory. By treating these agglomerates in accordance with the present invention, their reduction strength is raised to the required values. In this way, it is possible to save energy already in agglomeration.

The detrimental elements resulting from such treatment, which may enter the blast furnace, together with the burden, are discharged either with the slag or in the top gas.

The invention will now be explained in detail by a number of examples. If not expressly mentioned otherwise, the burden materials examined, were immersed for a short period into the halogen containing solution and, after dripping off of the solution, dried in a drying oven at 105° C.±5° C. By weighing the burden materials before and after drying, the amount of solution which was absorbed, was determined and, from this figure, the absorption of reagent calculated. Analytical checks resulted in excellent agreements with the calculated values. The metallurgical tests were then carried out directly on the burden materials treated.

All disintegration tests were conducted in conformity with Stahl-Eisen-Prufblatt No. 1771 of VDEh of 24-10-1979.

EXAMPLE 1

Here, the influence of the concentration of NaCl containing solution upon reduction disintegration of iron ore pellets of the chemical analysis of Table 1 is tested.

TABLE 1

| Chemical Analysis of Iron Ore Pellets (wt. %) | | | |
|---|---|---|---|
| Fe | 64.1 | S | <0.01 |
| FeO | 0.5 | P | 0.02 |
| $SiO_2$ | 2.90 | $Na_2O$ | 0.049 |
| $Al_2O_3$ | 0.73 | $K_2O$ | 0.045 |
| CaO | 2.61 | Cl | <0.005 |

TABLE 1-continued

| Chemical Analysis of Iron Ore Pellets (wt. %) | |
|---|---|
| MgO | 1.23 |

Basicity $CaO:SiO_2$ = 0.9

From Table 2 it can be seen that reduction strength and reduction abrasion can be improved by adding NaCl containing solutions, and that the values increase over and above those of untreated pellets with increasing concentration of NaCl. The results show that when treating the pellets with a NaCl solution of 2.5 g/l (grams per liter)≙0.25%, disintegration strength is improved from 71 wt. % to 85 wt.%>6.3 mm, while, at the same time, disintegration abrasion is reduced from 20 wt. % to 9 wt. %<0.5 mm. These are values which fully meet today's specifications. It has been found that raising the concentration above 10 g/l does not bring about a further improvement in strength.

TABLE 2

| (Test Results) | Solution Concentration | | | | |
|---|---|---|---|---|---|
| | ← NaCl → | | | | |
| Reduction disintegration | none | 1 g/l | 2.5 g/l | 5 g/l | 10 g/l |
| Reduction strength | | | | | |
| wt. % + 6.3 mm | 71 | 73 | 85 | 95 | 95 |
| wt. % + 3.15 mm | 77 | 78 | 88 | 95 | 96 |
| Reduction abrasion wt. % − 0.5 mm | 20 | 17 | 9 | 4 | 4 |
| Analysis of pellets as to (in wt. %) | | | | | |
| $Na_2O$ | 0.049 | 0.051 | 0.053 | 0.057 | 0.062 |
| $K_2O$ | 0.045 | 0.045 | 0.045 | 0.045 | 0.045 |
| Cl | <0.005 | 0.007 | 0.009 | 0.013 | 0.019 |

Table 1 shows the chemical analysis of the pellets tested. As will be noted from Table 2, when increasing the concentration in NaCl, the absorption of $Na_2O$ and $Cl^-$ portions by the pellets also increases, and that proportional with the rise in concentration. On the whole, however, such increase is small and insignificant. As shown in Table 2, by the treatment with a 0.25 % NaCl solution, the $Na_2O$ content of the pellets has increased by 0.004 % or 40 g/t pellets, and by the same amount for $Cl^-$. This corresponds to an increase of about 60 g per tonne of pig iron. The critical load of the blast furnace is not affected by these small amounts.

EXAMPLE 2

Following, the influence of the type of solutions upon the reduction disintegration of iron ore pellets is investigated. The chemical analysis of the iron ore pellets corresponds to the one given for the pellets of Example 1 in Table 1.

Table 3 shows that by treating the pellets with solutions containing halides of NaCl, CKl and $CaCl_2$, the reduction strength is improved, while there is no effect achieved with solutions of $Na_2CO_3$ and $Na_4P_2O_7$. In order to prove that also the other halogens, as, for instance, iodine, bromine and fluorine, are efficient components for such a treatment, and that solutions containing halides, have a positive effect on the reduction strength—independent of the feed materials, i.e. iron ore and pellet grades—Tables 5 and 6 list the results of corresponding tests.

TABLE 3

| Reduction disintegration | (Test Results) Solution Concentration none | NaCl 10 g/l | KCl 10 g/l | $CaCl_2$ 10 g/l | $Na_2CO_3$ 10 g/l | $Na_4P_2O_7$ 10 g/l |
|---|---|---|---|---|---|---|
| Reduction strength | | | | | | |
| wt. % + 6.3 mm | 71 | 95 | 85 | 96 | 70 | 70 |
| wt. % + 3.15 | 77 | 96 | 87 | 97 | 75 | 73 |
| Reduction abrasion wt. % − 0.5 mm | 20 | 4 | 11 | 3 | 22 | 21 |
| Analysis of pellets as to (in wt. %) | | | | | | |
| $Na_2O$ | 0.049 | 0.062 | 0.049 | 0.049 | 0.061 | 0.060 |
| $K_2O$ | 0.045 | 0.045 | 0.064 | 0.045 | 0.045 | 0.045 |
| $Cl^-$ | <0.005 | 0.019 | 0.019 | 0.025 | <0.005 | <0.005 |
| CaO | 2.61 | 2.61 | 2.61 | 2.63 | 2.61 | 2.61 |
| P | 0.02 | 0.02 | 0.02 | 0.02 | 0.02 | 0.03 |

EXAMPLE 3

This example illustrates the effect of the type of solutions upon the reduction disintegration of iron ore pellets (Table 4).

TABLE 4

| Chemical Analysis of the Iron Ore Pellets (%) | | | |
|---|---|---|---|
| Fe | 63.7 | S | <0.01 |
| FeO | 0.2 | P | 0.10 |
| $SiO_2$ | 4.82 | $Na_2O$ | 0.06 |
| $Al_2O_3$ | 1.86 | $K_2O$ | 0.05 |
| CaO | 0.95 | $Cl^-$ | <0.005 |
| MgO | 0.38 | $J^-$ | <0.005 |

Basicity $CaO:Sio_2$ = 0.20

The results determined and listed in Table 5 which relate to the treatment of the pellets of Table 4 with KBr, KJ and $Na_2SiF_6$ solutions, prove that such solutions are suited for minimizing reduction disintegration just as well as solutions containing NaCl, KCl and $CaCl_2$. Thus, chlorides, bromides iodides and fluorides can be regarded as suitable means for inhibiting or minimizing disintegration, and that independent of cations present in a compound.

EXAMPLE 4

Example 4 examines the effect of the treatment with a NaCl solution upon the reduction disintegration of different pellet grades.

TABLE 5

| Reduction disintegration | (Test Results) Solution Concentration none | NaCl 5 g/l | NaCl 10 g/l | KJ 10 g/l | KBr 10 g/l | $Na_2SiF_6$ 5 g/l |
|---|---|---|---|---|---|---|
| Reduction strength | | | | | | |
| wt. % + 6.3 mm | 33 | 56 | 94 | 80 | 85 | 58 |
| wt. % + 3.15 mm | 53 | 73 | 95 | 88 | 90 | 70 |
| Reduction abrasion wt. % − 0.5 mm | 28 | 14 | 4 | 7 | 6 | 17 |
| Analysis of the pellets as to (wt. %) | | | | | | |
| $Na_2O$ | 0.06 | 0.071 | 0.082 | 0.06 | 0.06 | 0.074 |
| $K_2O$ | 0.05 | 0.05 | 0.05 | 0.06 | 0.07 | 0.05 |
| $Cl^-$ | <0.005 | 0.017 | 0.029 | <0.005 | <0.005 | <0.005 |
| $J^-$ | <0.005 | <0.005 | <0.005 | 0.032 | <0.005 | 0.018 |
| $Br^-$ | <0.005 | <0.005 | <0.005 | <0.005 | 0.026 | <0.005 |

TABLE 6

| Chemical analysis of the pellets (wt. %) | (Test Results) Grade A without treatment | A with NaCl solution 5 g/l | B without treatment | B with NaCl solution 10 g/l | C without treatment | C with NaCl solution 5 g/l | D without treatment | D with NaCl solution 2.5 g/l | E without treatment | E with NaCl solution 5 g/l | F without treatment | F with NaCl solution 5 g/l | G without treatment | G with NaCl solution 5 g/l |
|---|---|---|---|---|---|---|---|---|---|---|---|---|---|---|
| Fe | 64.7 | | 63.7 | | 63.5 | | 64.1 | | 65.2 | | 65.0 | | 65.0 | |
| FeO | 0.4 | | 0.2 | | 0.9 | | 0.5 | | 0.5 | | 0.2 | | 0.8 | |
| $SiO_2$ | 6.10 | | 4.82 | | 8.22 | | 2.90 | | 3.33 | | 3.55 | | 2.80 | |
| $Al_2O_3$ | 0.34 | | 1.86 | | 0.30 | | 0.73 | | 0.75 | | 0.38 | | 0.94 | |
| CaO | 0.34 | | 0.95 | | 0.10 | | 2.61 | | 2.41 | | 3.08 | | 2.84 | |
| MgO | 0.30 | | 0.38 | | 0.20 | | 1.23 | | 0.03 | | 0.13 | | 0.23 | |
| S | <0.01 | | <0.01 | | <0.01 | | <0.01 | | <0.01 | | <0.01 | | <0.01 | |
| P | 0.02 | | 0.10 | | 0.02 | | 0.02 | | 0.01 | | 0.03 | | 0.03 | |
| $Na_2O$ | 0.09 | 0.102 | 0.06 | 0.082 | 0.04 | 0.046 | 0.049 | 0.053 | 0.01 | 0.021 | 0.01 | 0.020 | 0.03 | 0.039 |
| $K_2O$ | 0.03 | 0.03 | 0.05 | 0.05 | 0.04 | 0.04 | 0.045 | 0.045 | 0.01 | 0.01 | 0.015 | 0.015 | 0.03 | 0.03 |
| $Cl^-$ | <0.005 | 0.018 | <0.005 | 0.029 | <0.005 | 0.012 | <0.005 | 0.009 | <0.005 | 0.018 | <0.005 | 0.016 | <0.005 | 0.016 |

TABLE 6-continued

| Chemical analysis of the pellets (wt. %) | (Test Results) Grade A without treatment | A with NaCl solution 5 g/l | B without treatment | B with NaCl solution 10 g/l | C without treatment | C with NaCl solution 5 g/l | D without treatment | D with NaCl solution 2.5 g/l | E without treatment | E with NaCl solution 5 g/l | F without treatment | F with NaCl solution 5 g/l | G without treatment | G with NaCl solution 5 g/l |
|---|---|---|---|---|---|---|---|---|---|---|---|---|---|---|
| Basicity $CaO:SiO_2$ | 0.06 | | 0.20 | | 0.01 | | 0.9 | | 0.72 | | 0.87 | | 1.01 | |
| Feed ore for making pellets | Magnetite | | Magnetite | | Magnetite Hematite | | Hematite | | Hematite/ Limonite | | Hematite/ Limonite | | Hematite/ Limonite | |
| Reduction disintegration | | | | | | | | | | | | | | |
| Reduction strength | | | | | | | | | | | | | | |
| wt. % + 6.3 mm | 58 | 87 | 33 | 94 | 71 | 81 | 71 | 85 | 78 | 93 | 60 | 79 | 75 | 85 |
| wt. % + 3.15 mm | 85 | 93 | 53 | 95 | 90 | 90 | 77 | 88 | 82 | 94 | 62 | 81 | 78 | 86 |
| Reduction abrasion | | | | | | | | | | | | | | |
| wt. % − 0.5 mm | 6 | 4 | 28 | 4 | 4 | 4 | 20 | 9 | 15 | 5 | 37 | 17 | 19 | 12 |
| Moisture thru NaCl solution % | — | 4.2 | — | 3.4 | — | 3.5 | — | 2.9 | — | 4.1 | — | 3.5 | — | 3.5 |

As will be noted from Table 6, seven different iron ore pellet grades made from different feed raw materials, were tested. NaCl solutions in concentrations from 2.5 g/l to 10 g/l were chosen as halide-bearing reagents. It will be seen that even by the treatment of the pellets with only a 0.05% NaCl solution, the disintegration strength is increased. Here, pellet grade A serves as an example, where the reduction strength was improved from 58 wt. %+6.3 mm before the treatment to 87 wt. %+6.3 mm after the treatment. Reduction disintegration decrease from 6 wt. %−0.5 mm before the treatment to 4 wt. %−0.5 mm after the treatment.

When treating the pellets, an absorption of $H_2O$ cannot be avoided. For the examples of Table 6, it amounts to between 2.9% and 4.2% $H_2O$. However, a moisture content of this order is within the admissible scope for commercial pellets. Nevertheless, such $H_2O$ contents can be reduced by increasing the halogen concentration in the solutions, in particular, when using sea water or similar solutions in higher concentrations of about 30 g/l as NaCl. The real amount can easily be determined by simple tests.

EXAMPLE 5

Apart from pellets, also different grades of iron ore sinter were included in the tests. So, the reduction strength of different sinter grades was tested by treatment with NaCl solutions of different concentrations. The results of these test have been listed in Table 7.

TABLE 7

| Chemical analysis of the sinter (wt. %) | (Test Results) Grade A Test sinter without treatment | A with NaCl solution 10 g/l | B Test sinter without treatment | B with NaCl solution 30 g/l | C Commercial sinter without treatment | C with NaCl solution 10 g/l | C with NaCl solution 30 g/l |
|---|---|---|---|---|---|---|---|
| Fe | 57.6 | | 56.8 | | | 57.7 | |
| FeO | 7.2 | | 6.8 | | | 4.0 | |
| $SiO_2$ | 5.85 | | 5.88 | | | 5.98 | |
| $Al_2O_3$ | 1.18 | | 1.25 | | | 1.28 | |
| CaO | 9.20 | | 9.60 | | | 9.70 | |
| MgO | 1.62 | | 1.62 | | | 0.26 | |
| S | 0.01 | | 0.01 | | | 0.01 | |
| P | 0.035 | | 0.038 | | | 0.04 | |
| $Na_2O$ | 0.017 | 0.028 | 0.020 | 0.053 | 0.030 | 0.042 | 0.055 |
| $K_2O$ | 0.029 | 0.029 | 0.037 | 0.037 | 0.060 | 0.060 | 0.060 |
| $Cl^-$ | <0.01 | 0.023 | <0.01 | 0.047 | <0.01 | 0.013 | 0.029 |
| Basicity $CaO:SiO_2$ | 1.57 | | 1.63 | | | 1.62 | |
| Feed ore for making sinter | Mixture of different ores | | Single ore | | Mixture of different ores | | |
| Reduction disintegration | | | | | | | |
| Reduction strength | | | | | | | |
| wt. % + 6.3 mm | 11 | 74 | 10 | 74 | 15 | 33 | 54 |
| wt. % + 3.15 mm | 39 | 86 | 40 | 87 | 43 | 64 | 77 |
| Reduction abrasion | | | | | | | |

TABLE 7-continued

| | (Test Results) Grade | | | | | | |
|---|---|---|---|---|---|---|---|
| | A Test sinter | | B Test sinter | | C Commercial sinter | | |
| Chemical analysis of the sinter (wt. %) | without treat-ment | with NaCl solution 10 g/l | without treat-ment | with NaCl solution 30 g/l | without treat-ment | with NaCl solution 10 g/l | with NaCl solution 30 g/l |
| wt. % − 0.5 mm | 21 | 7 | 19 | 7 | 20 | 13 | 10 |
| Moisture thru NaCl solution % | — | 2.0 | — | 2.0 | — | 2.1 | 2.3 |

As can be seen from Table 7, a treatment with NaCl solutions has a distinctly inhibiting effect on all sinter grades tested, even in high dilution, without changing the other quality characteristics, as mechanical strength, reducibility and strength at a reduction temperature of 1,050° C. One arrives at figures which are absolutely unattainable for sinter not subjected to such treatment.

An improvement in strength and, thus, a minimizing in reduction disintegration can also successfully achieved for lump ores when treating these with solutions which contain halides. However, in these cases much higher concentrations of halides are necessary. At any rate, the invention is also applicable to lump ores.

A major advantage of the subject of the invention is to be seen in the fact, that treatments of iron ores or iron ore agglomerates with reagents or solutions containing halides can be done both by producer and consumer and even during transport from the producer to the consumer. Since transport and storage of iron ores and pellets mostly take place in the open air, a certain washing-out effect must be expected, if the treatment is done in advance. This effect is clearly demonstrated in the following example.

EXAMPLE 6

This Example illustrates the influence of the washing-out effect of pellets treated with a NaCl solution, upon reduction disintegration and upon the $Na_2O$, $K_2O$ and $Cl^-$ contents by absorption of water.

The chemical analysis of the pellets is the same as in Example 3, Table 4.

TABLE 8

| | (Test Results) Solution concentration | | |
|---|---|---|---|
| Reduction disintegration | none | NaCl 10 g/l | NaCl 10 g/l The pellets treated with the above solution, were subsequently sprinkled with 100 mm precipitation in six hours; afterwards, reduction disintegration and analysis were as follows: |
| Reduction strength | | | |
| wt. % + 6.3 mm | 33 | 94 | 63 |

TABLE 8-continued

| | (Test Results) Solution concentration | | |
|---|---|---|---|
| Reduction disintegration | none | NaCl 10 g/l | NaCl 10 g/l The pellets treated with the above solution, were subsequently sprinkled with 100 mm precipitation in six hours; afterwards, reduction disintegration and analysis were as follows: |
| wt. % + 3.15 mm | 53 | 95 | 76 |
| Reduction abrasion wt. % − 0.5 mm | 28 | 4 | 13 |
| Analysis of the pellets as to (in wt. %) | | | |
| $Na_2O$ | 0.06 | 0.07 | 0.07 |
| $K_2O$ | 0.05 | 0.05 | 0.05 |
| $Cl^-$ | <0.005 | 0.017 | 0.010 |

The results lisyted in Table 8, show that the pellets tested had almost completely lost their tendency to disintegration after treatment with 1% NaCl solution. The pellets had absorbed only 0.01% of $Na_2O$ and about 0.012% of $Cl^-$. Based on a precipitation of 100 mm, washing-out had resulted in a decrease in $Na_2O$ by less than 0.01% and in a decrease in $Cl^-$ by 0.007%. On the other hand, the tendency to disintegration has risen to figures which are just about in the middle between the figures for untreated and treated pellets.

EXAMPLE 7

This Example shows how a pellet grade whose disintegration behaviour deteriorated because of certain storage periods, can be improved to a fully satisfactory strength level by treatment with a NaCl solution.

TABLE 9

| Chemical Analysis of the Pellets (wt. %) | | | |
|---|---|---|---|
| Fe | 65.5 | S | <0.01 |
| FeO | 0.5 | P | 0.02 |
| $SiO_2$ | 4.00 | $Na_2O$ | 0.06 |
| $Al_2O_3$ | 0.26 | $K_2O$ | 0.02 |
| CaO | 0.28 | $Cl^-$ | <0.005 |
| MgO | 0.32 | | |

Basicity $CaO:SiO_2$ = 0.07

TABLE 10

| | (Test Results) | | | | | |
|---|---|---|---|---|---|---|
| | Pellets used | | | | | |
| | immediately after production | after 2 weeks storage | after 4 weeks storage | | after 7 weeks storage | |
| | Solution Contration | | | | | |
| Reduction disintegration | none | none | none | NaCl 5 g/l | none | Nacl 10 g/l |
| Reduction strength | | | | | | |
| wt. % + 6.3 mm | 93 | 75 | 68 | 89 | 65 | 91 |
| wt. % + 3.15 mm | 98 | 96 | 94 | 96 | 96 | 96 |
| Reduction abrasion wt. % − 0.5 mm | 2 | 2 | 2 | 1 | 2 | 1 |
| Analysis of pellets as to (in wt. %) | | | | | | |
| $Na_2O$ | 0.06 | 0.06 | 0.06 | 0.07 | 0.06 | 0.08 |
| $K_2O$ | 0.02 | 0.02 | 0.02 | 0.02 | 0.02 | 0.02 |
| Cl | <0.005 | <0.005 | <0.005 | 0.011 | <0.005 | 0.023 |

Table 10 is a compilation of test results arrived at for Example 7, where pellets specified in Table 9, were treated after different storage periods. Again, the figures of Table 10 illustrate that according to the present invention, a high reduction strength is achieved, when compared to untreated pellets, and that for pellets which had been subjected to periods of storage in the open air, a high reduction strength can be restored, when the rules of the instant invention are applied.

The same process can also be applied to sinter whose characteristics had deteriorated because of outside storage.

We claim:

1. A method for minimizing disintegration of pieces of iron ore agglomerates during reduction of pieces of iron ore agglomerates in a blast furnace comprising surface-treating the iron ore agglomerates directly before being fed to the blast furnace with halogenide reagents, where the surface treating is performed until the pieces of iron ore agglomerates have an analytical content of from about 0.001 to 0.1 weight percent in halogen, which surface treating with halogenides minimizes reduction disintegration of the iron ore agglomerates when exposed to temperatures in the blast furnace in the range of from about 400 to 600 degrees centigrade under reducing conditions; feeding the surface-treated iron ore agglomerates into a blast furnace; and exposing the surface treated agglomerates in the blast furnace to temperatures in the range of from about 400 to 600 degrees centigrade under reducing conditions.

2. The method for minimizing disintegration of pieces of iron ore agglomerates during reduction of pieces of iron ore agglomerates in a blast furnace according to claim 1 wherein the reagents employed are solutions containing halogenides.

3. The method for minimizing disintegration of pieces of iron ore agglomerates during reduction of pieces of iron ore agglomerates in a blast furnace according to claim 1 wherein the halogenide reagent is a member of the group comprising sea water, liquids having a composition with a halogenide salt content corresponding to the halogenide salt content of sea water, and aqueous solutions containing halogen in an amount of from about 0.1 to 50 grams per liter.

4. The method for minimizing disintegration of pieces of iron ore agglomerates during reduction of pieces of iron ore agglomerates in a blast furnace according to claim 1 wherein the reagents are employed as aqueous solutions containing halogenides where the amount of halogen is from about 1 to 20 gram per liter of solution.

5. The method for minimizing disintegration of pieces of iron ore agglomerates during reduction of pieces of iron ore agglomerates in a blast furnace according to claim 1 wherein the reagents are sprayed upon the pieces.

6. The method for minimizing disintegration of pieces of iron ore agglomerates during reduction of pieces of iron ore agglomerates in a blast furnace according to claim 1 wherein the halogenide reagents are in solid form at the time of treatment.

7. The method for minimizing disintegration of pieces of iron ore agglomerates during reduction of pieces of iron ore agglomerates in a blast furnace according to claim 1 wherein the pieces are immersed in a bath containing a solution of halogenides.

8. The method for minimizing disintegration of pieces of iron ore agglomerates during reduction of pieces of iron ore agglomerates in a blast furnace according to claim 1 wherein the pieces are sinter.

9. The method for minimizing disintegration of pieces of iron ore agglomerates during reduction of pieces of iron ore agglomerates in a blast furnace according to claim 1 wherein the treatment of the pieces with the halogenide reagents is effected immediately prior to the feeding of the pieces into the blast furnace.

10. The method for minimizing disintegration of pieces of iron ore agglomerates during reduction of pieces of iron ore agglomerates in a blast furnace according to claim 1 wherein the blast furnace is a low shaft furnace.

11. The method for minimizing disintegration of pieces of iron ore agglomerates during reduction of pieces of iron ore agglomerates in a blast furnace according to claim 1 wherein the reagent employed is an aqueous solution containing a member of the group consisting of sodium chloride, magnesium chloride, calcium chloride, potassium chloride, potassium iodide, potassium bromide, sodium hexafluoro silicate, and mixtures thereof.

12. The method for minimizing disintegration of pieces of iron ore agglomerates during reduction of pieces of iron ore agglomerates in a blast furnace according to claim 1 wherein the pieces are pellets.

13. The method for minimizing disintegration of pieces of iron ore agglomerates during reduction of pieces of iron ore agglomerates in a blast furnace according to claim 1 wherein the surface-treating is performed until the pieces of iron ore agglomerates have an analytical content of from about 0.01 to 0.03 weight percent in halogen.

14. The method for minimizing disintegration of pieces of iron ore agglomerates during reduction of pieces of iron ore agglomerates in a blast furnace according to claim 1 wherein the pieces are disposed on a transporting belt during the treatment process.

15. Pieces of iron ore agglomerates containing a deposit of a soluble halogenide on its surface accessible to contact with liquid, where the total halogenide amount corresponds to an analytical content of from about 0.001 to 0.1 weight percent of halogen of the agglomerates.

16. The pieces of iron ore agglomerates according to claim 15 wherein the halogenide comprises a member of the group consisting of sodium chloride, magnesium chloride, calcium chloride, ferrous chloride, ferric chloride, potassium chloride, manganes chloride, and mixtures thereof.

17. The pieces of iron ore agglomerates according to claim 15 wherein the analytical halogen content is from about 0.01 to 0.03 weight percent.

18. A method for minimizing disintegration of pieces of iron ore agglomerates during reduction of pieces of iron ore agglomerates in a blast furnace comprising feeding a blast furnace with iron ore agglomerates otherwise ready for use in a blast furnace, which agglomerates had been treated on their surface with a halogenide reagent, where the surface treating is performed until the pieces of iron ore agglomerates have an analytical content of from about 0.001 to 0.1 weight percent in halogen, which surface treating with halogen minimizes reduction disintegration of the iron ore agglomerates when exposed to temperatures in the blast furnace in the range of from about 400 to 600 degrees centigrade.

19. The method for minimizing disintegration of pieces of iron ore agglomerates during reduction of pieces of iron ore agglomerates in a blast furnace according to claim 18 wherein the reagents employed are solutions containing halogenides.

20. The method for minimizing disintegration of pieces of iron ore agglomerates during reduction of pieces of iron ore agglomerates in a blast furnace according to claim 1 wherein the reagent is a member of the group comprising sea water, liquids having a composition with a halogenide salt content corresponding to the halogenide salt content of sea water, and aqueous solutions containing halogen in an amount of from about 0.1 to 50 grams per liter.

21. A method for minimizing disintegration of pieces of iron ore agglomerates during reduction of pieces of iron ore agglomerates in a blast furnace comprising surface-treating iron ore agglomerates otherwise ready for use in a blast furnace with halogenide reagents, where the surface treating is performed until the pieces of iron ore agglomerates have an analytical content of from about 0.001 to 0.1 weight percent in halogen, which surface treating with halogenides minimizes reduction disintegration of the iron ore agglomerates when exposed to temperatures in the blast furnace in the range of from about 400 to 600 degrees centigrade.

22. A method for minimizing disintegration of pieces of iron ore agglomerates during reduction of pieces or iron ore agglomerates in a blast furnace comprising surface-treating the iron ore agglomerates directly before being fed to the blast furnace with halogenide reagents at a temperature below 110 degrees centigrade, where the surface treating is performed until the pieces of iron ore agglomerates have an analytical content of from about 0.001 to 0.1 weight percent in halogen, which surface treating with halogenides minimizes reduction disintegration of the iron ore agglomerates when exposed to temperatures in the blast furnace in the range of from about 400 to 600 degrees centigrade under reducing conditions;

feeding the surface-treated iron ore agglomerates into a blast furnace; and exposing the surface treated agglomerates in the blast furnace to temperatures in the range of from about 400 to 600 degrees centigrade under reducing conditions.

23. A method for minimizing disintegration of pieces of iron ore agglomerates during reduction of pieces of iron ore agglomerates in a blast furnace comprising surface-treating the iron ore agglomerates directly and without intermediate heating before being fed to the blast furnace with halogenide reagents at a temperature below 110 degrees centigrade, where the surface treating is performed until the pieces of iron ore agglomerates have an analytical content of from about 0.001 to 0.1 weight percent in halogen, which surface treating with halogenides minimizes reduction disintegration of the iron ore agglomerates when exposed to temperatures in the blast furnace in the range of from about 400 to 600 degrees centigrade under reducing conditions;

feeding the surface-treated iron ore agglomerates into a blast furnace; and exposing the surface-treated agglomerates in the blast furnace to temperatures in the range of from about 400 to 600 degrees centigrade under reducing conditions.

* * * * *